US006382715B1

(12) United States Patent
Tang

(10) Patent No.: US 6,382,715 B1
(45) Date of Patent: May 7, 2002

(54) COLLAPSIBLE CHILDREN'S PATIO CHAIR

(76) Inventor: Larry Tang, 45 Park Knoll Dr., East Brunswick, NJ (US) 08816

( * ) Notice: Subject to any disclaimer, the term of this patent is extended or adjusted under 35 U.S.C. 154(b) by 0 days.

(21) Appl. No.: 09/929,660

(22) Filed: Aug. 15, 2001

(51) Int. Cl.[7] ..... A47C 4/47
(52) U.S. Cl. ..... 297/16.2; 297/45; 297/59
(58) Field of Search ..... 297/16.2, 45, 59

(56) References Cited

U.S. PATENT DOCUMENTS 5,882,068 A * 3/1999 Levine ..... 297/16.2 X
5,984,406 A * 11/1999 Lee ..... 297/16.2
6,237,993 B1 * 5/2001 Zheng ..... 297/16.2
6,270,156 B1 * 8/2001 Metzger ..... 297/16.2
6,302,479 B1 * 10/2001 Zheng ..... 297/16.2

* cited by examiner

*Primary Examiner*—Peter R. Brown
(74) *Attorney, Agent, or Firm*—Charles I. Brodsky

(57) ABSTRACT

A patio chair incorporating a frame having pairs of crossed front, rear and side legs, and with front and rear connectors for stabilizing the chair when opened and for collapsing the chair to a compact package when closed, and with compressible pins at the rear connectors to be captured by snap action in forming a positive locking securement against accidental closing and against closing by small children.

10 Claims, 11 Drawing Sheets

COLLAPSIBLE CHILDREN'S PATIO CHAIR

BACKGROUND OF THE INVENTION

1. Field of the Invention

This invention relates to foldable chairs, in general, and to a collapsible children's patio chair especially useful for casual seating, in particular.

2. Description of the Related Art

Folding or collapsible chairs in the nature of furniture have been described in such as U.S. Pat. No. 3,635,520 (Roher et al) and U.S. Pat. No. 5,984,406 (Lee). In a multiple seat arrangement, they are also described in U.S. Pat. No. 5,570,928 (Staunton et al). For outdoor use, in camping and watching sports games, chairs of this type have been illustrated in U.S. Pat. No. 5,893,605 (Chang). When a reclining chair is desired for camping, hiking, fishing, and concert events, a construction of the type shown in U.S. Pat. No. 5,882,068 (Levine) is said to be useful.

While chairs of these types may prove adequate to suit their intended purposes, their acceptability depends in large part upon their strength and reliability of operation. In these two areas, the folding chair of the Lee Patent (U. S. Pat. No. 5,984,406) falls somewhat short.

A significant improvement of these collapsible chairs is described in my pending United States Patent Application, entitled Collapsible Patio Chair, filed Apr. 28, 2000 as Ser. No. 09/561,339, now U.S. Pat. No. 6,322,138. However, the patio chair of the present invention goes one step further by being particularly attractive for use by children, in having the folding chair automatically locked in place once it is opened. The added safety feature which results will be seen to follow whether the patio chair be provided with an armrest—as in my Ser. No., 09/561,339 Application, or whether it be provided without an armrest.

SUMMARY OF THE INVENTION

As will become clear from the following description, the collapsible children's patio chair of the invention consists of a frame including pairs of front crossed legs and rear crossed legs, and two pairs of side crossed legs, with each pair of crossed legs being pivotally connected together where they cross; first and second front pad connectors pivotally connected to lower ends of one of the front crossed legs and one of the side crossed legs, respectively; first and second rear pad connectors pivotally connected to lower ends of one of the rear crossed legs and the other of the side crossed legs, respectively; first and second front connectors pivotally connected to upper ends of the one front crossed leg and the other of the side crossed legs, respectively; first and second rear connectors pivotally connected to upper ends of the rear crossed legs and the one side crossed leg, respectively; a pair of side supports passing through apertures in each of the first and second rear connectors having lower ends fixedly connected to the rear pad connectors; and a fabric liner connected to the first and second front connectors and to upper ends of the pair of side supports.

To provide strength and reliability of operation beyond that characterizing the patented Lee design, the front connectors of the frame include a top surface having a notch therein open at one end and slightly larger than the diameter of the front crossed legs when composed as a tubular configuration, a first wall at an underside thereof defining one side of the notch and to which the upper ends of the front crossed legs are pivotally connected and a second wall at the underside, generally perpendicular to the first wall and combined therewith, to which the upper ends of the other of the side crossed legs are also pivotally connected. In like manner, each of the front and rear connector pads (as well as the rear connectors) include the two generally perpendicular walls for fastening with their respective pivotally connected legs—while the rear connector pads include apertures at the join of the two walls where the side supports are fixed.

In accordance with a particular aspect of the present invention, a compressible pin is included on each side support to snap within an aperture in the adjacent rear connector to form a positive locking securement—whether the collapsible chair be provided with, or without armrests. Whereas such compressible pin is preferably incorporated on a side support, it will be readily apparent to those skilled in the art that the orientation can be reversed—namely, with the compressible pin incorporated on a rear connector to snap fit into an aperture on the side support—again, either for the patio chair design with an armrest inclusion, or without such implementation.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
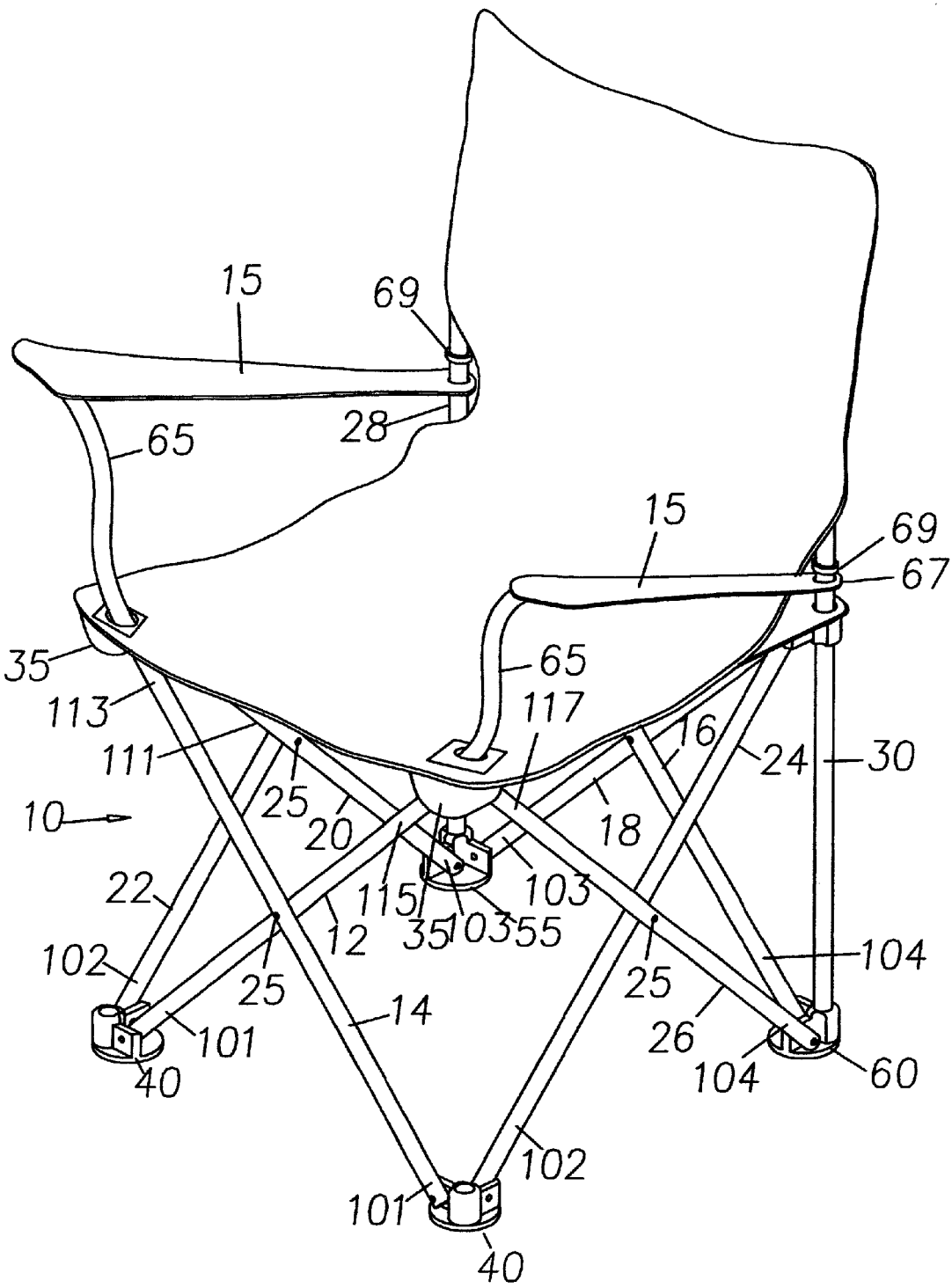
FIG. 1 is a front perspective view of the collapsible patio chair of my Ser. No. 09/561,339 Application, in its unfolded position, helpful in an understanding of the present invention.

As with the folding chair of my application Ser. No. 09/561,339, the collapsible children's patio chair of the present invention is constructed of tubular members. In particular, the frame of the patio chair 10 includes eight crossed legs in pairs of two each—front legs 12, 14, rear legs 16, 18, and side legs 20, 22 and 24, 26. As illustrated, each of the pairs 12 & 14, 16 & 18, 20 & 22 and 24 & 26 are joined together by pivot pins 25. The frame 10, furthermore, includes a pair of side supports 28, 30—which, like the crossed legs 12 & 14, 16 & 18, 20 & 22 and 24 & 26 are tubular, and are constructed of aluminum or steel.

A pair of front connectors 35 join the crossed legs 14 & 20 and 12 & 26 together at their upper ends. A pair of front pad connectors 40 join the crossed legs 12 & 22 together, as well as the crossed legs 14 & 24, at their bottom ends. Similarly, two rear connectors 45, 50 respectively connect the upper ends of crossed legs 16 & 22 and 18 & 24 at their upper ends. Two rear pad connectors 55, 60 respectively join the lower ends of the crossed legs 18 & 20 and 16 & 26. As shown in FIGS. 1–4, the side supports 28, 30 respectively extend downwardly through apertures 33, in the rear connectors 45, 50, to fix with the rear pad connectors 55 and 60 without pivoting. With the patio chair to be constructed with armrests (FIGS. 1 and 2), each front leg 12, 14 is provided with an extension 65 that extends upwardly through the front connectors 35 and bends outwardly to form a front support 66 where it is secured, as by a screw, with a sleeve at a front underside of a fabric armrest (15, in FIG. 1), at the rear of which a grommet 67 on the fabric encircles the side supports 28, 30, and where it is restricted in upwards movement by a ring 69 on the supports 28, 30. As with the armrests of my application Ser. No. 09/561,339, the armrest 15 provides a support for the user's arm, as well as a manner to fold and unfold the chair with adequate leverage.

Particularly referring to FIGS. 1–2, 5A & 5B, and 6A & 6B, the lower end 101 of the crossed legs 12 & 14 are fastened by rivet or other pivot manner to the front wall 84 of the front pad connector 40 shown as having a generally perpendicular side wall 83, the fastener passing through its aperture 86A. Similarly, the lower end 102 of the crossed legs 22 & 24 is also fastened by rivet, or other pivot to the wall 83, by means of its aperture 86B. As illustrated, both front pad connectors 40 are identical, with one of the lower ends 101 being pivoted on one surface of the front wall 84, with the other one of the lower ends 101 being on the opposite surface of the front wall 84, and with the two lower ends 102 being pivoted on opposing faces of the side wall 83.

Figure 6B:
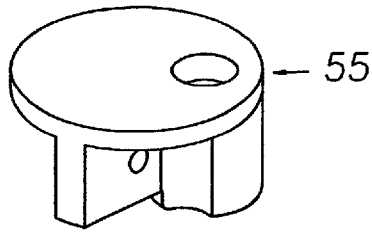
Figure 5A:
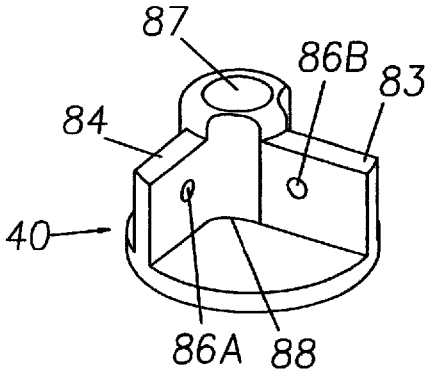
Figure 6A:
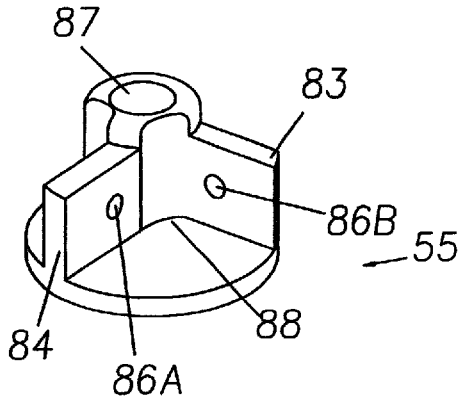
Figure 7A:
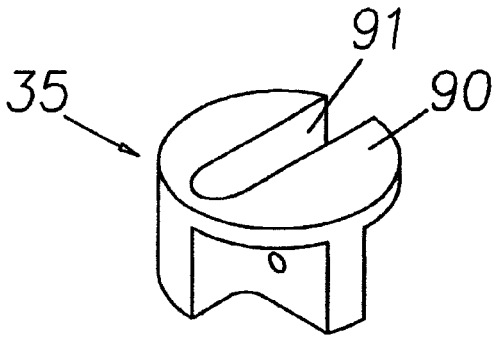
FIGS. 7A & 7B and 8A & 8B are top and bottom perspective views respectively of the front connectors of the collapsible patio chair of FIG. 1.
Figure 7B:
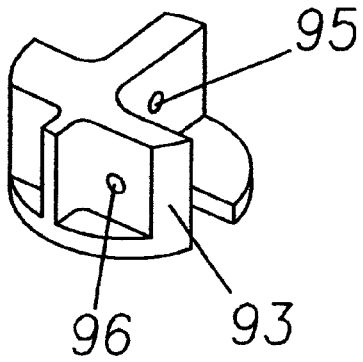
Figure 8A:
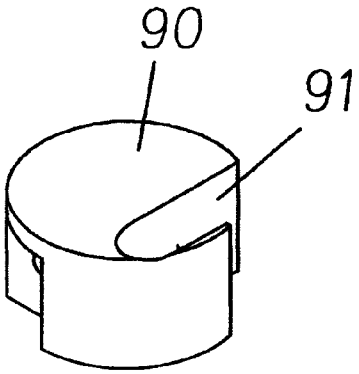
Figure 8B:
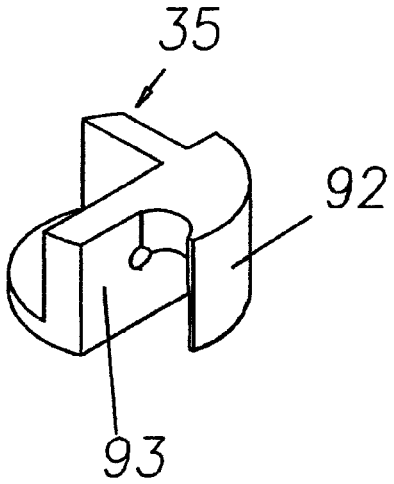

In like manner, the lower end 103 of the crossed legs 18 & 20 and the lower end 104 of the crossed legs 16 & 26 are fastened by rivets, or other pivots to the rear pad connectors 55, 60 respectively, with the rear pad connector 55 being of the configuration shown in FIGS. 6A & 6B, and with the rear pad connector 60 being of the configuration shown in FIGS. 6A & 6B rotated 90° counterclockwise. Each of the connectors 55, 60 thus include their own pairs of generally perpendicular walls and their own apertures. As indicated, the lower end 103 of leg 20 is fastened by pivot or otherwise to rear pad connector 55 at one surface of the wall 84 via aperture 86A while the lower end 103 of leg 18 is fastened by pivot or otherwise to one surface of the wall 83 via aperture 86B. Correspondingly, the lower end 104 of leg 26 is fastened to the opposing surface of wall 84 of connector 60 via aperture 86A, while the lower end 104 of leg 16 is fastened to the opposing surface of wall 83 via aperture 86B. In accordance with the construction, apertures 87 are included at the joinings 88 of the walls 83, 84 of the connectors 55, 60 to receive the lower ends of the side supports 28, 30, where they are fixed by rivets or otherwise, without pivoting. Although not receiving side supports, the front pad connectors 40 may be constructed with a similar aperture 87 at the joinings 88 of their walls 83, 84, to allow for a common construction of these front and rear pad connectors and an interchangeability of components, although such apertures 87 at the front pad connectors are not needed for operation of the collapsible patio chair.

The upper end 111 of leg 20 and the upper end 113 of leg 14 are fastened together in front connector 35 in manner identical to the fastening in connector 35 of upper end 115 of leg 12 and upper end 117 of leg 26. The connectors 35 are illustrated in FIGS. 7A & 7B and 8A & 8B—with the configurations of FIG. 7A & 7B receiving the legs 12 and 26, and with the configuration of FIGS. 8A and 8B receiving the legs 14 and 20. As shown, the connectors 35 include a top surface 90 having a notch therein 91 open at one end, understood to be slightly larger than the diameter of the crossed legs 12, 14 when composed as a tubular configuration. This dimensioning allows the legs 12, 14 to glide easily within the notch 91 as the patio chair is folded closed or opened. As more particularly shown in FIGS. 7B and 8B, the front connectors 35 further include a first wall 92 at an underside defining one side of the notch 91 and to which the legs 14 and 12 are fastened. At the same time, the connectors 35 include a second wall 93 at the underside, generally perpendicular to the wall 92 in combination therewith, to which the upper ends 111 and 117 of the crossed legs 20 and 26 are fastened. In similar manner, both perpendicular walls 92, 93 are provided with apertures 95, 96 for fastening with their respective pivotally connected legs.

Figure 2:
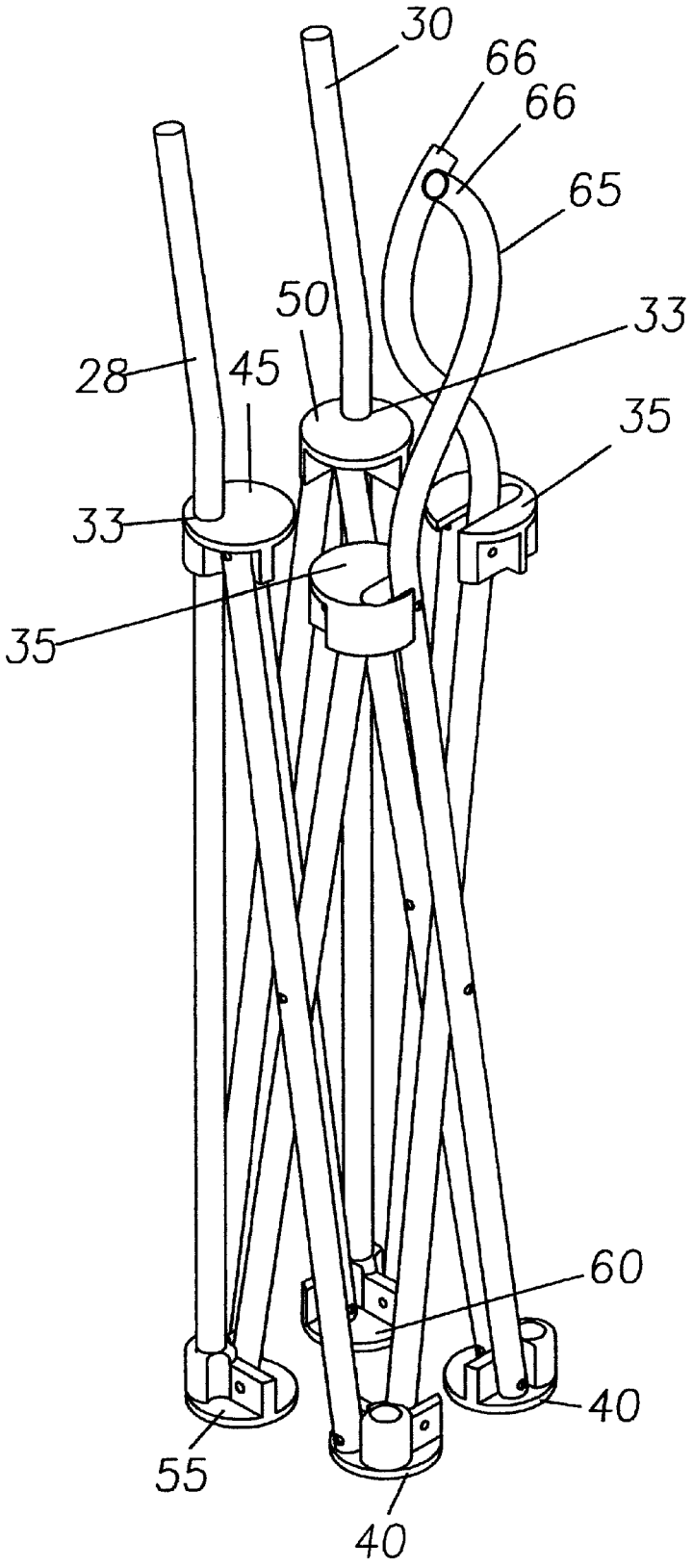
FIG. 2 is a front perspective view of such patio chair when fully collapsed, with the seating fabric removed, ready for storage.
Figure 3:
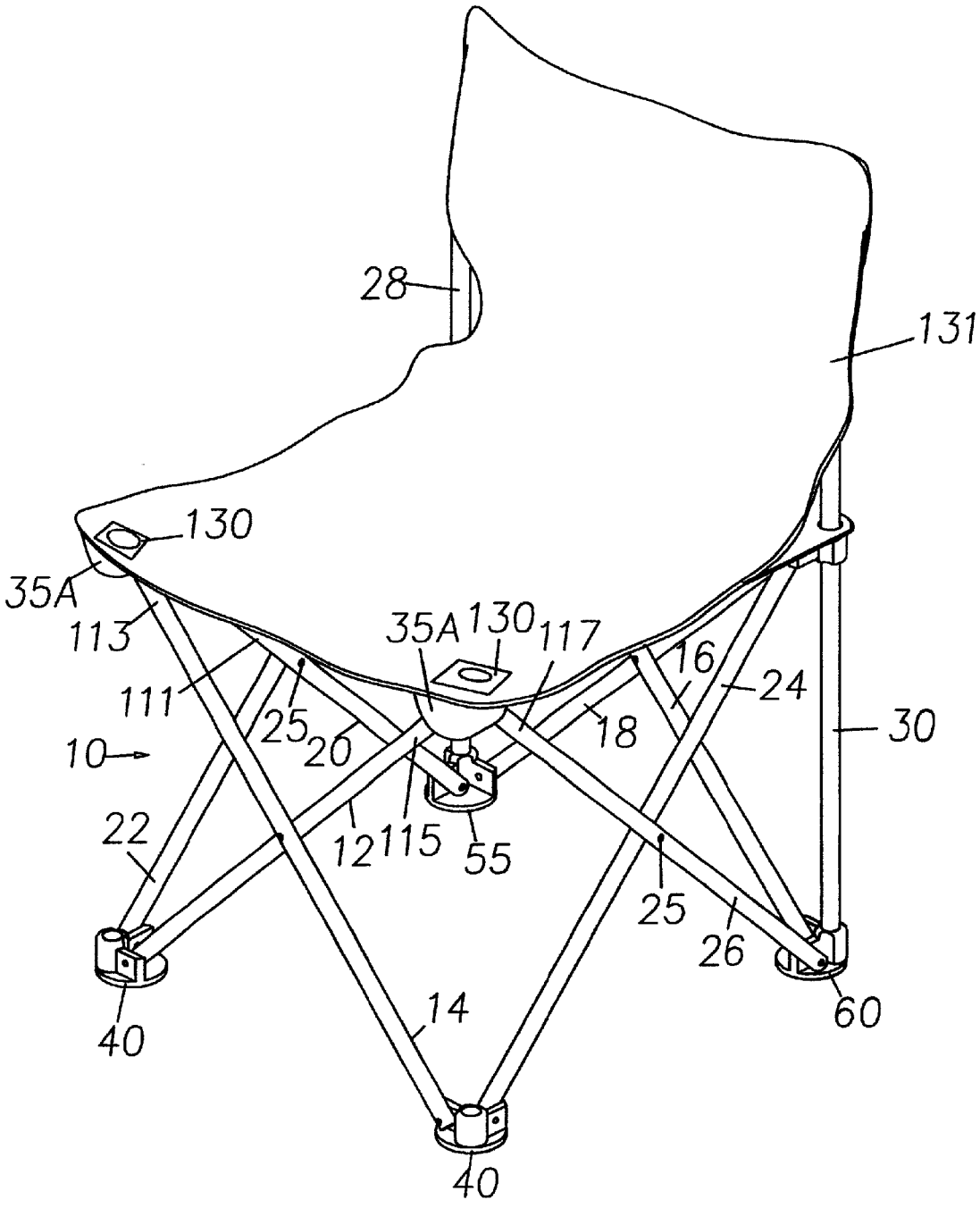
FIG. 3 is a front perspective view of a second collapsible patio chair in its unfolded position with which the teachings of the present invention—as with the collapsible patio chair of FIG. 1—is particularly attractive.
Figure 4:
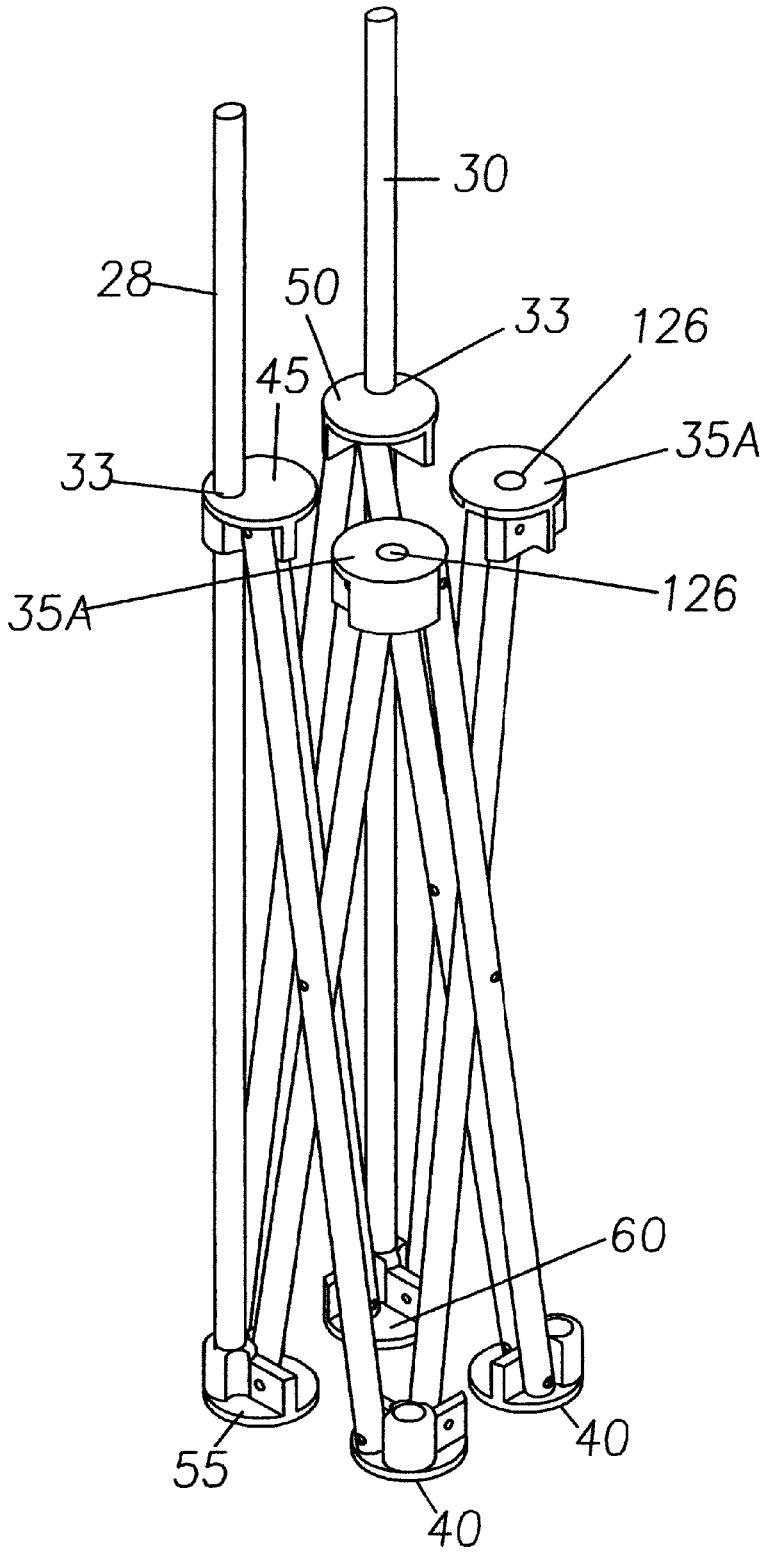
FIG. 4 is a front perspective view of the patio chair of FIG. 3 when fully collapsed, without the seating fabric, ready for storage.
Figure 5B:
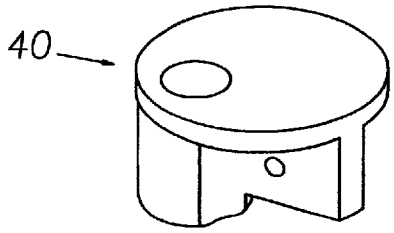
FIGS. 5A & 5B and 6A & 6B are top and bottom perspective views respectively of the front and rear pad connectors of the collapsible patio chairs of FIGS. 1 and 3.

As so far described, except for the front connectors 35 of FIGS. 1 and 2, and of FIGS. 7A, 7B, 8A and 8B, the collapsible patio chair of FIGS. 3 and 4 without the armrest 15 is identical to the collapsible patio chair of FIGS. 1 and 2 where the armrest 65 is included.

Figure 9A:
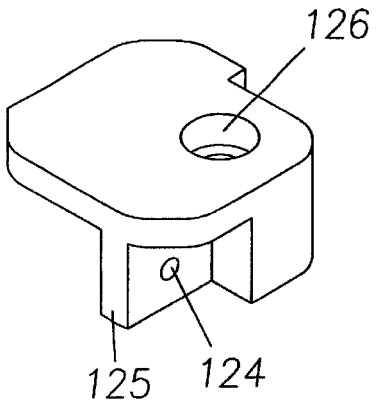
FIGS. 9A & 9B, 12A & 12B and 13A & 13B are varieties of perspective views of various component parts of the collapsible patio chair of the invention which allow the chair to be unfolded open and folded closed.
Figure 9B:
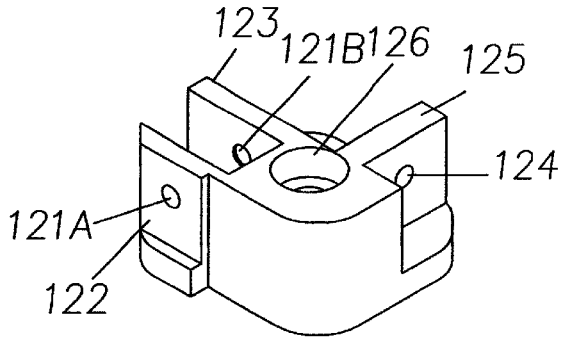

With the patio chair of FIGS. 3 and 4, the upper end 111 of leg 20 and the upper end 113 of leg 14 are fastened together in front connector 35A in a manner identical to the fastening in connector 35A of upper end 115 of leg 12 and upper end 117 of leg 26. The connectors 35A are illustrated in FIGS. 9A and 9B with one of the legs (20 or 12) being fastened through the apertures 121A and 121B of two parallel walls 122, 123, and with the other of the legs (14 or 26) being fastened through the aperture 124 of the perpendicular wall 125. The aperture 126 will be understood as receiving a screw or like fastener extending upwardly through the connector 35A to join with a cap 130 which holds the fabric liner 131 of the chair in place along the front of the seat (FIG. 3).

Figure 10:
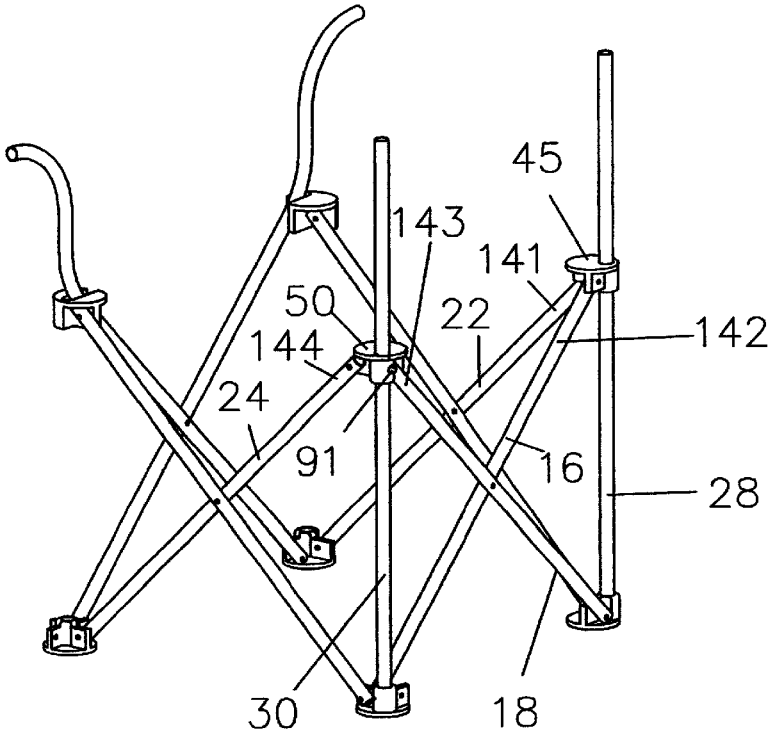
FIG. 10 is a front perspective view of the collapsible children's patio chair of the invention in its unfolded position designed for armrests although with the seating fabric removed.
Figure 11:
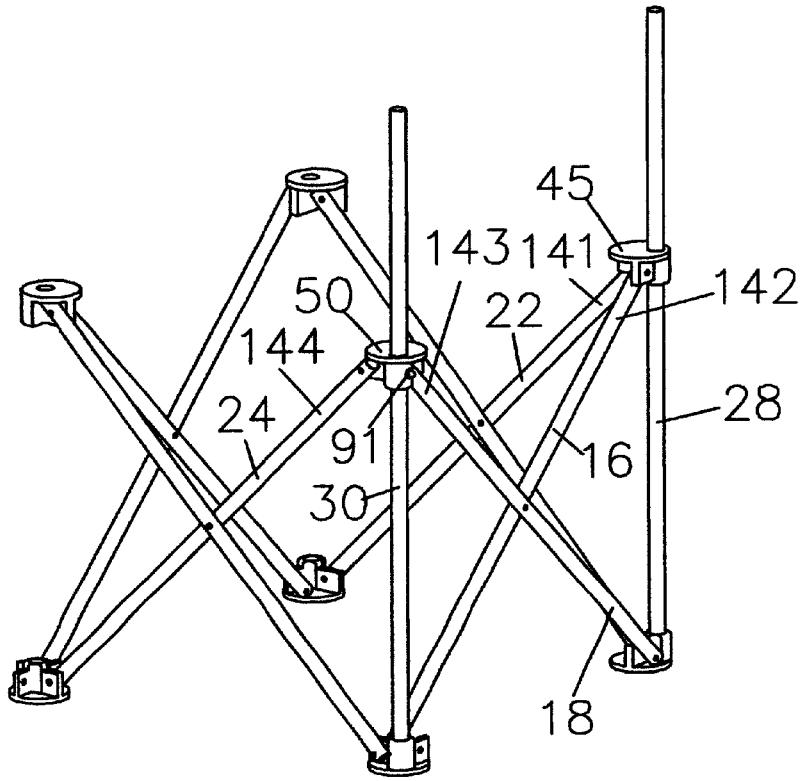
FIG. 11 is a front perspective view of the collapsible children's patio chair in its unfolded position, also without any seating fabric in place, and without provisions for armrest.
Figure 14A:
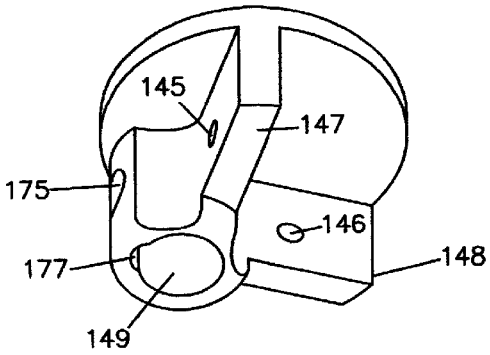
FIGS. 14A–14D are views helpful in an understanding of the captive locking securement of the collapsible chair once unfolded, according to the invention.
Figure 14D:
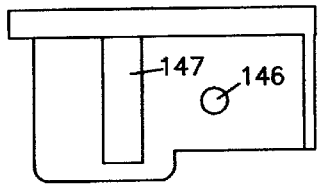
Figure 14C:
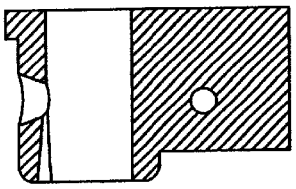
Figure 14B:
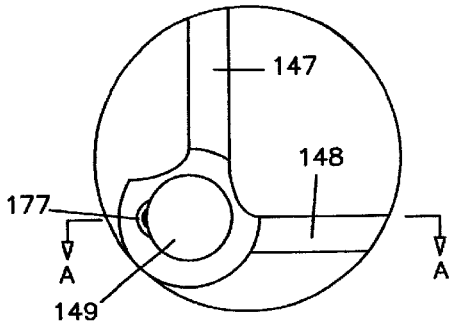

The improvement of the present invention for the collapsible children's patio chair—with the armrest and without the armrest, respectively—, is illustrated in FIGS. 10 and 11. The upper end 141 of the leg 22 is coupled with the upper end 142 of leg 16 within the rear connector 45, designed as a mirror image of the rear connector 50 which receives the upper end 143 of leg 18 and the upper end 144 of leg 24. These connectors 45 and 50 are illustrated in FIGS. 12A & 12B and 13A & 13B, respectively, with one leg fastened through each aperture 145, 146 of the perpendicular walls 147 and 148, and with the aperture 149 corresponding to the aperture 33 in the connectors 45 and 50 of FIGS. 1 and 3. In accordance with the captive locking securement afforded by the invention, furthermore, a further aperture 175 is provided in the rear connectors 45, 50 and an outward protrusion notch 177 is provided at the aperture 149, as shown in FIG. 14A—and as more particularly shown in the top view of FIG. 14B and in the sectional view of FIG. 14C, taken along the section line A—A in FIG. 14B. FIG. 14D shows the front view.

Figure 15A:
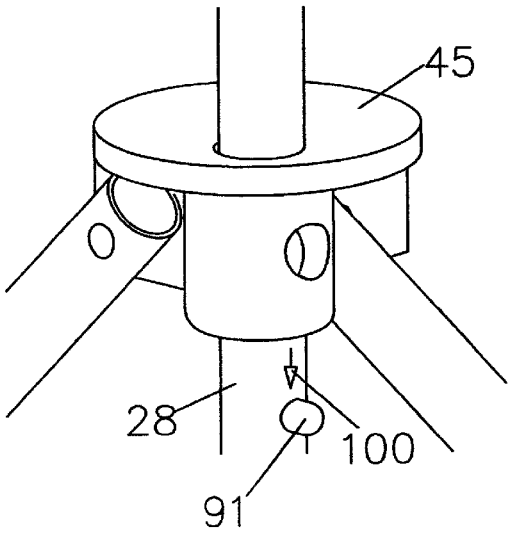
FIGS. 15A & 15B and 16A & 16B illustrate the operation of the captive securement feature.
Figure 15B:
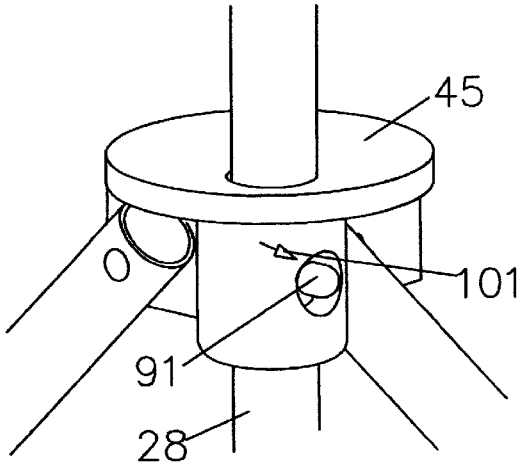
Figure 16A:
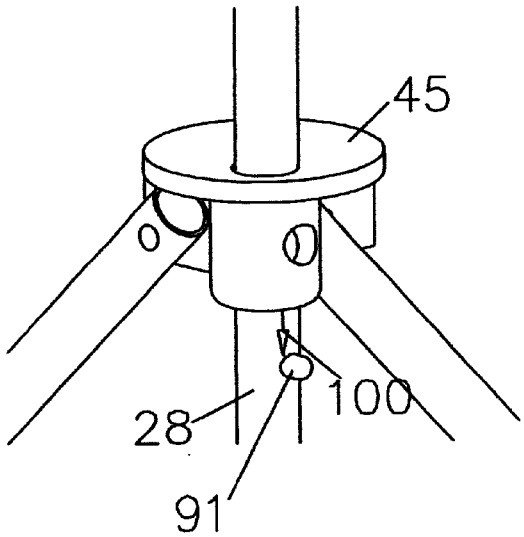
Figure 16B:
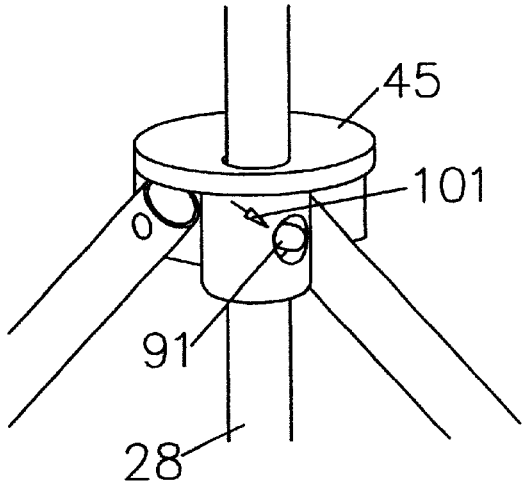
Figure 13A:
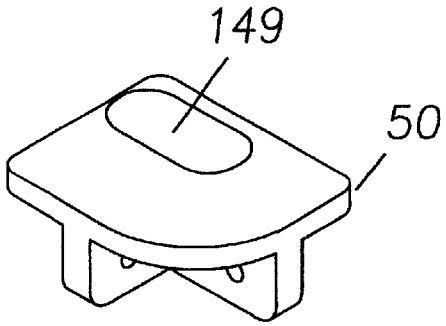
Figure 13B:
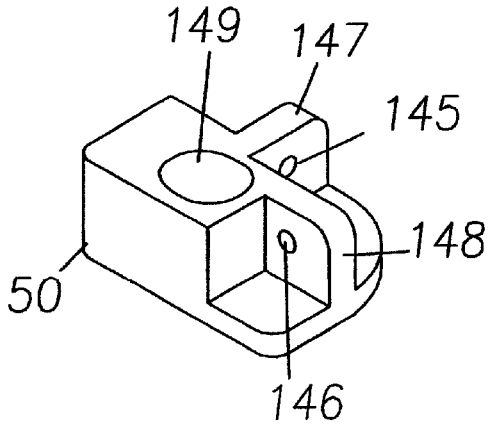
Figure 12A:
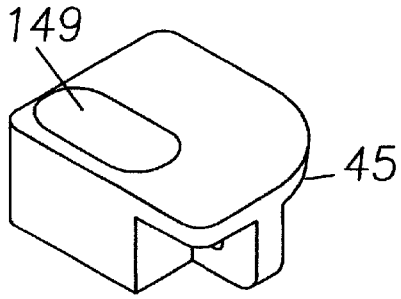
Figure 12B:
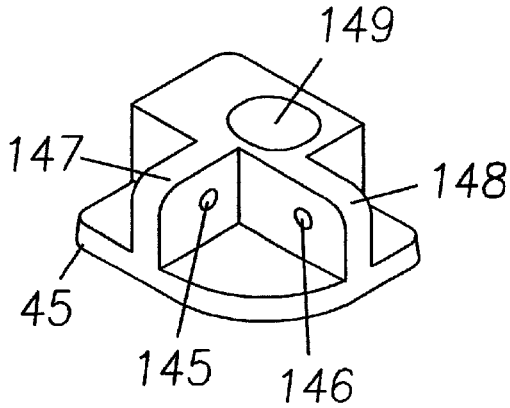

Referring to FIGS. 15A and 15B, and to FIGS. 16A and 16B, the side supports 28, 30 of the collapsible children's patio chair are each provided with a compressible pin 91. Such pin 91 is of configuration to orient with, and fit within the aperture 175 of the rear connector 45, 50 as the connector is moved downwardly at the position shown in FIGS. 10 and 11 when unfolding the collapsible chair to its open position. This is illustrated in FIGS. 15A and 16A by the arrow 100, and in FIGS. 15B and 16B by the arrow 101 once the compressible pin 91 is captured in position. Aperture 175 thereby captures the compressible pin 91 by snap action to form the positive locking securement needed when the patio chair is to be employed by a small child. In such respect, the resistance of the compressible pin 91 can be selected not only to hold the patio chair in its unfolded position, but to prevent against accidental, or even forceful attempts by the child to close the patio chair for storage. Obviously, if so desired, the side supports 28, 30 could be designed to include its own aperture instead, with the rear connectors 45, 50 then having the compressible pin spring-biased to fit within such aperture when slid along the side support 28, 30. As will be apparent, the male-female interconnection can be arranged in either direction. In either arrangement, the notch 177 serves as a guide for the compressible pin 91 to lock automatically without having to first push the pin to position.

FIGS. 10 and 11 illustrate the location of the rear connectors 45, 50 with the compressible pin 91 locked in place in the unfolded position of the collapsible children's patio chair for both the construction with the included armrest, and without the included armrest, respectively. When configuring these rear connectors, it will be appreciated that the placement of the compressible pin is preferably at a position corresponding to the height when the chair is unfolded for use. With the connectors being of a plastic construction, its tubing configuration will then snap the pin into the aperture in providing the desired lock. As will be apparent, such chair could be locked even under the usage of a child in unfolding the chair, merely pushing down on the rear connector. However, it will take the force of an adult to compress the pin and then draw the rear connector upwardly in folding the chair to a closed position for storage. In this respect, the chair can be protected against accidental closing, or against a child's own devices in trying to fold the chair to the stored position.

While there have been described what are considered to be preferred embodiments of the present invention, it will be readily appreciated by those skilled in the art that modifications can be made without departing from the scope of the teachings herewith. Thus, for example, while the invention has been described in the context of using a compressible pin which snaps into position, it will be apparent that other types of locking arrangements could be employed as well to extend on the side supports in uniting with the rear connectors to lock the collapsible chair. For at least such reason, therefore, resort should be had to the claims appended hereto for a true understanding of the invention.

I claim:

1. A collapsible chair comprising:

a frame including pairs of front crossed legs and rear crossed legs, and two pairs of side crossed legs, with each pair of crossed legs being pivotally connected together where they cross;

first and second front pad connectors pivotally connected to lower ends of one of said front crossed legs and one of said side crossed legs, respectively;

first and second rear pad connectors pivotally connected to lower ends of one of said rear crossed legs and the other of said side crossed legs, respectively;

first and second front connectors pivotally connected to upper ends of said one front crossed leg and said other of said side crossed legs, respectively;

first and second rear connectors pivotally connected to upper ends of said rear crossed legs and said one of said side crossed legs, respectively;

a pair of side supports passing through apertures in each of said first and second rear connectors having lower ends fixedly connected to said rear pad connectors;

a fabric liner connected to said first and second front connectors and to upper ends of said pair of side supports; and first and second lock mechanisms releasably coupled between said pair of side supports and said first and second rear connectors.

2. The collapsible chair of claim 1 wherein said front connector includes a first wall at an underside thereof defining a first side of said notch and to which said upper ends of said front crossed legs are pivotally connected, and a second wall at said underside, generally perpendicular to said first wall and combined therewith, to which said upper ends of said other of said side crossed legs are pivotally connected.

3. The collapsible chair of claim 2 wherein each of said front and rear connectors pads include a pair of generally perpendicular walls for fastening with their respective pivotally connected legs, and wherein said rear connector pads include apertures at the joinings of said perpendicular walls where said side supports are fixed, without pivoting.

4. The collapsible chair of claim 1, wherein said first and second lock mechanisms adjustably interconnect said pair of side supports with said first and second rear connectors in unfolding said collapsing chair open.

5. The collapsible chair of claim 1, wherein said first and second lock mechanisms adjustably decouple said pair of side supports from said first and second rear connectors in folding said collapsing chair closed.

6. The collapsible chair of claim 1 wherein each of said front and rear pad connectors include a pair of perpendicular apertured walls;

with one wall of said first and second front connectors being pivotally connected on opposite sides with said lower ends of said front crossed legs;

with the other wall of said first and second front pad connectors being pivotally connected on opposite sides with said lower ends of said one side crossed leg;

with one wall of said first and second rear pad connectors being pivotally connected on opposite sides with said lower ends of said rear crossed legs; and with the other wall of said first and second rear pad connectors being pivotally connected on opposite sides with said lower ends of said other side crossed legs.

7. The collapsible chair of claim 1, including a collapsible pin along said pair of side supports, and wherein said first and second lock mechanisms include an aperture in said first and second rear connectors for receiving said pin in securement therewith.

8. The collapsible chair of claim 7 wherein said aperture receives said pin in a snap fit therewith.

9. The collapsible chair of claim 1, including a collapsible pin within said first and second rear connectors and wherein said first and second lock mechanisms include an aperture in said pair of side supports for receiving said pin in securement therewith.

10. The collapsible chair of claim 9 wherein said aperture receives said pin in a snap fit therewith.

* * * * *